United States Patent [19]

Sperry et al.

[11] 4,094,705

[45] June 13, 1978

[54] ALUMINUM ALLOYS POSSESSING IMPROVED RESISTANCE WELDABILITY

[75] Inventors: Philip R. Sperry, Chesterfield, Mo.; Frank N. Mandigo, Northford, Conn.

[73] Assignee: Swiss Aluminium Ltd., Chippis, Switzerland

[21] Appl. No.: 781,718

[22] Filed: Mar. 28, 1977

[51] Int. Cl.[2] ..... C22F 1/04; C22C 21/06

[52] U.S. Cl. ..... 148/2; 75/141; 75/142; 75/146; 75/147; 148/11.5 A; 148/32

[58] Field of Search ..... 75/142, 147, 146, 141; 148/32, 32.5, 2, 11.5 A

[56] References Cited

U.S. PATENT DOCUMENTS 3,582,406 6/1971 Ford ..... 148/11.5 A

*Primary Examiner*—R. Dean

*Attorney, Agent, or Firm*—Robert H. Bachman

[57] ABSTRACT

Aluminum alloys exhibiting improved resistance weldability as well as excellent strength and formability characteristics are prepared which comprise 1.-5.% magnesium, 0.3-1.0% lithium, up to 1.0% manganese, up to 0.3% titanium, up to 0.20% vanadium, and balance essentially aluminum. The alloys of the present invention are particularly suited for automotive and like metal parts.

23 Claims, No Drawings

ALUMINUM ALLOYS POSSESSING IMPROVED RESISTANCE WELDABILITY

BACKGROUND OF THE INVENTION

The present invention relates to the preparation of aluminum alloys possessing an unusually advantageous combination of properties, particularly with regard to high strength, which is well retained at elevated temperatures as compared to known non-heat-treatable alloys, excellent formability, and favorable weldability characteristics, especially adapted for improved electric resistance welding of parts formed of wrought sheet. These alloys, being readily convertible to rolled sheets or plates displaying excellent formability, are particularly adapted for the production of body parts for transport vehicles including cars, trucks, barges, tanks and like articles.

Two physical properties of aluminum are especially important in the practice of resistance spot welding, the electrical resistivity, which is known to be low by comparison with well-known steels and therefore necessitates high welding currents for proper welds, and the contact resistance at the metal surface, which causes pick-up or sticking of the metal to the welding electrodes and undue variations in the size, shape and strength of the resulting weld when the values vary and are too high.

In view of improving the efficiency of energy consumption, it has become more urgent to accomplish reductions in the weight of motor vehicle parts. As a result, aluminum sheet alloys, which have been used extensively in the aircraft industry, as well as alloys of more moderate strength and greater formability, are of interest because of their reduced weight, good corrosion resistance, and other favorable properties. An important factor, however, in the consideration of aluminum is the question of its adaptability to the resistance welding techniques presently useful with the steels currently employed. Thus, the ease of resistance welding in terms of minimal control and lower current requirements comprises an important factor which makes it desirable to provide aluminum alloys exhibiting improved resistance weldability. Thus, a minimal requirement for a suitable aluminum alloy is that it should display increased electrical resistivity, as a reduction in total current requirements would render less critical the problems associated with contact resistance.

It has therefore been a principal object of this invention to provide aluminum base alloys characterized by a favorable combination of strength properties, which are well retained at elevated temperatures, useful formability, and excellent weldability, especially by resistance welding.

A further object has been to provide aluminum base alloys wherein the electrical resistivity has been substantially increased as compared to aluminum and its previously known commercial alloys, without impairment of strength, ductility and formability properties.

Another object has been the formulation of non-heat-treatable aluminum base alloy compositions, and procedures for producing them in wrought form, having improved electrical resistivity and capable of withstanding elevated temperatures without undue loss of strength and formability properties.

Further objects and advantages of the present invention will be apparent from the following description.

SUMMARY OF THE INVENTION

The foregoing objects have been found to be advantageously attained in accordance with the present invention.

In accordance with this invention, aluminum alloys possessing improved resistance weldability in combination with advantageous strength and formability properties are prepared which comprise 1.0–5.0% magnesium, 0.3–1.0% lithium, 0–1.0% manganese, 0–0.3% titanium, and 0–0.2% vanadium, balance essentially aluminum. Other optional elements and impurities may be present, as indicated below.

The alloys of the present invention exhibit decreases in conductivity, and corresponding increases in resistivity, over comparable alloys not containing lithium within the above range, and are particularly suited for automotive body panels and similar parts. Further, the performance of lithium in the above range contributes to desirable ductility and formability, excellent strength properties, and their improved retention at elevated temperatures, by virtue of its entry into solid solution in the alloy.

DETAILED DESCRIPTION

The aluminum base alloys of the present invention comprise, in weight percent, 1.0–5.0% magnesium, 0.3–1.0% lithium, 0–1.0% manganese, 0–0.3% titanium, and 0–0.2% vanadium, balance essentially aluminum. In a preferred embodiment, the alloys of the present invention may contain 2.0–4.0% magnesium, 0.4–0.8% lithium, 0.1–0.7% manganese and/or 0.1–0.2% titanium and/or 0.05–0.15% vanadium, balance essentially aluminum.

Aluminum base alloys in accordance with the present invention may in certain cases be prepared by the addition of 0.3–1.0% lithium to compositions included in the Aluminum Association 5000 Series of alloys. In addition to the elements stated above, the alloys of the present invention may include the following optional additives: copper up to 0.4%, and preferably from 0.05–0.2%, chromium up to 0.4%, nickel up to 0.3%, zirconium up to 0.15%, and zinc up to 0.3%. Also, other impurity elements may be present in amounts of 0.05–0.4% each and totaling not more than 0.45%, not adversely affecting the properties of the alloy, such as iron or silicon.

Compositions within the above-defined ranges provide alloys of improved performance characteristics. In general, amounts of the elements less than the stated minimum values are insufficiently effective to produce the desired result, while amounts above the specified maximum values tend to become proportionately less effective for the intended result than the initial additions or may even produce some deleterious effect. Thus, amounts of magnesium beyond the prescribed upper limit tend to increase stress corrosion problems undesirably. If lithium is added in excessive proportions, the additional amounts may not readily enter into solid solution and thus fail to effect the desired increase in electrical resistivity or may alter the alloy characteristics, as by imparting heat-treatability.

As noted above, it has been found in accordance with the present invention that aluminum base alloys of the 5000 Series to which lithium has been added in the above stated amounts display improved resistance weldability by virtue of the resulting increase in the resistivity of the alloy. This stems partly from the fact that lithium confers a relatively strong incremental increase in resistivity (3.31 $\mu\Omega$ — cm per weight percent) and, within the specified range, is capable of remaining in saturated solid solution in the alloy. Further, while not substantially altering the basic characteristics of the alloy such as melting range, corrosion resistance, finishing characteristics or the like, the lithium component enhances certain physical properties and improves the retention of strength properties at elevated temperatures.

The 5000 Series alloys possess characteristics favorable for use in auto body panel and similar applications, which result from the combined elements comprising the primary alloying ingredients. Thus, magnesium is a significant alloy ingredient which confers significant strengthening and a high rate of work hardening. Manganese further improves strength properties, without substantially sacrificing ductility. Two alloys of the 5000 Series which appear to possess great potential in automotive applications are designated by the Aluminum Association as Alloys 5052 and 5454, which broadly comprise 2.0 to about 3.0% magnesium, up to about 0.45% of a total of iron and/or silicon, balance essentially aluminum. These alloys may further contain up to about 0.10% copper, up to about 0.8% manganese, up to about 0.35% chromium, up to 0.25% zinc, up to 0.15% zirconium, and up to about 0.20% titanium, as well as other impurities in amounts of up to 0.05%, the total not exceeding 0.15%, which would not materially affect the properties of the composition. As with other members of the 5000 Series, the above alloys exhibit improved resistivity as the result of the addition of lithium in an amount ranging from 0.30% to 1.0%.

A further example of such an alloy possessing recognized utility in auto body applications is Alloy 5182, which comprises 4.0–5.0% magnesium, up to about 0.35% iron, up to about 0.20% silicon, up to about 0.15% copper, 0.20–0.50% manganese, up to about 0.10% chromium, up to about 0.25% zinc, up to about 0.15% zirconium, and up to 0.10% titanium, balance aluminum. This alloy contains a fairly large percentage of magnesium which, as noted earlier, provides strengthening and improved work hardening, and may likewise be modified by the stated addition of lithium to improve its resistivity, and thus its adaptability to resistance welding.

The alloys of the present invention may be processed in accordance with conventional practices and techniques. Thus, the alloys may be cast by DC casting, hot worked, such as by hot rolling, at temperatures such as, for example, 850° F, and cold worked as, for example, by cold rolling to reductions of 50% or greater, in accordance with known procedures.

In addition to ease of processing, the alloys of this invention possess improved tensile properties, ductility and formability which are comparable to acceptable levels achieved by conventional alloys. Most importantly, conductivity measurements show that much or all of the lithium present in the alloys is retained in solid solution in the final annealed condition, with the result that the lithium-containing alloys were found to possess reduced levels of conductivity, corresponding with increased resistivity, in comparison with lithium-free alloys.

The present invention will be more readily understood from a consideration of the following detailed examples.

EXAMPLE I

Alloy A in accordance with the invention was prepared, as described below, having the following composition, by chemical analysis, percentages being by weight:

TABLE I

| Alloy | Mg | Li | Mn | Ti | Al |
|---|---|---|---|---|---|
| A | 2.52% | 0.60% | 0.55% | 0.14% | Balance |

The above composition was melted, thoroughly mixed, fluxed by treatment with a nitrogen-dichlorodifluormethane gas mixture, brought to a pouring temperature of 1300°–1350° F, such as 1320° F, and cast as ingots by the Durville method. After being scalped, the ingots were homogenized by heating to 900° F, and holding at that temperature for 4 hours. The ingots were than hot rolled at 700°–900° F, as at 850° F, to a thickness of 0.080 inch, with reheating between passes, and then cold rolled to a thickness of 0.030 inch. Annealing was then carried out by heating at a rate of 50° F per hour from 300° to 650° F, holding at 650° F for 3 hours, and air-cooling to ambient temperature. Measurements of tensile properties and conductivity were carried out on the resulting strip and additional tests were also made after further treatment, as described below.

EXAMPLE II

In order to establish the unique contributions of lithium in alloys in accordance with this invention, a series of comparison alloys, wherein other elements were substituted for lithium, was prepared, using the same process as described in Example I, percentages being by weight, as follows:

TABLE II

| Alloy | Mg | Li | Mn | Ti | Other | Al |
|---|---|---|---|---|---|---|
| 1 | 2.51% | — | 0.56 | 0.012 | — | Bal. |
| 2 | 2.50 | — | 0.54 | 0.15 | — | Bal. |
| 3 | 2.50 | — | 0.57 | 0.15 | 0.61 Ni | Bal. |
| 4 | 2.40 | — | 0.57 | 0.13 | 0.028 Be | Bal. |

As stated above, none of these alloys contained lithium, while each contained similar proportions of Mg and Mn. Alloy 1 included only sufficient Ti for grain refining in the cast ingot, and the other alloys included a further proportion of this element. Alloy 3 was additionally provided with Ni, which is effective to produce fine and uniform dispersion of precipitated particles, so as to furnish comparative data with respect to this factor. Comparison alloy 4, containing added Be, known as an additive tending to enhance ductility, was included in the series to indicate the extent to which the lithium addition in alloy A might be affecting the formability characteristics of the composition.

Conductivity measurements which were made of the above alloys in fully annealed condition are summarized in Table III.

TABLE III

| Alloy | Electrical Conductivity % IACS |
|---|---|
| A | 22.5 |
| 1 | 32.3 |
| 2 | 29.9 |
| 3 | 30.4 |
| 4 | 31.7 |

A substantial reduction in the electrical conductivity to about two-thirds of the comparable lithium-free alloys is thus confirmed, thereby establishing the improved adaptability of the alloy in accordance with this invention to electric resistance welding.

Tensile property measurements carried out on the above alloys in (a) the cold rolled (63% to 0.030 inch thickness) condition, (b) partially annealed (3 hours at 550° F) and (c) fully annealed (3 hours at 650° F) are summarized in Table IV:

TABLE IV

| Alloy | Direction | Tensile Properties (a) Cold Rolled YS* | | UTS* | | E* |
|---|---|---|---|---|---|---|
| A | *Long. | 49.7 | ksi | 50.3 | ksi | 2.5% |
| | *Trans. | 49.0 | | 53.7 | | 3.0 |
| 1 | Long. | 44.6 | | 45.3 | | 2. |
| | Trans. | 44.3 | | 48.5 | | 3.5 |
| 2 | Long. | 46.3 | | 47.1 | | — |
| | Trans. | 46.2 | | 50.5 | | — |
| 3 | Long. | 49.6 | | 50.2 | | 2. |
| | Trans. | 48.1 | | 52.1 | | 2.8 |
| 4 | Long. | 46.5 | | 47.0 | | — |
| | Trans. | 46.5 | | 50.0 | | 2.8 |

*Abbreviations - YS = Yield Strength, UTS = Ultimate Tensile Strength, E = Elongation, Long. = Longitudinal, Trans. = Transverse (b) Partially Annealed

| Alloy | Direction | YS | UTS | E |
|---|---|---|---|---|
| A | Long. | 28.8 | 39.9 | 11.0 |
| | Trans. | 30.0 | 40.7 | 14.3 |
| 1 | Long. | 14.5 | 31.5 | 20.3 |
| | Trans. | 14.3 | 30.5 | 21.0 |
| 2 | Long. | 21.2 | 35.0 | 13.3 |
| | Trans. | 21.4 | 36.1 | 16.0 |
| 3 | Long. | 20.1 | 35.5 | 16.3 |
| | Trans. | 20.3 | 35.9 | 18.5 |
| 4 | Long. | 17.3 | 33.1 | 18.0 |
| | Trans. | 17.4 | 33.2 | 18.0 |

(c) Fully Annealed

| Alloy | YS | UTS | E |
|---|---|---|---|
| A | 17.0 | 34.7 | 19.5 |
| 1 | 14.2 | 31.0 | 19.5 |
| 2 | 15.0 | 32.2 | 19.0 |
| 3 | 16.8 | 33.9 | 19.3 |
| 4 | 14.4 | 31.3 | 20.8 |

The data in Table IV show that the addition of lithium to the aluminum-magnesium alloy has resulted in a significant strengthening effect in the alloy in worked or annealed state. The substantially higher strength values displayed in the partially annealed state establish the importance of the lithium addition as tending to enhance the retention of desired strength properties of cold worked structures even after appreciable heating. Thus, further advantage arises for the described addition of lithium with respect to improved adaptability of such alloys to welding procedures and other treatments at elevated temperatures of articles formed of the resulting alloys, such as the setting or curing of paints and coatings through the application of heat.

Measurements made in these alloys related to formability characteristics are summarized in Table V, wherein the table headings have the customary significance, for example, as defined in "ASTM Standards", Part 31, E-517, published by American Society for Testing and Materials, Philadelphia, Pennsylvania.

TABLE V

| Alloy | Long. | Trans. | 45° | Av. Δ R | R | n | K | Bend Radius |
|---|---|---|---|---|---|---|---|---|
| | FORMABILITY PARAMETERS | | | R Values | | | | |
| A | .51 | .69 | .76 | 0.68 | −.32 | 0.28 | 67. ksi | OT* |
| 1 | .68 | .77 | .62 | 0.67 | +.21 | 0.30 | 62. | OT |

TABLE V-continued

| Alloy | Long. | Trans. | 45° | Av. Δ R | R | n | K | Bend Radius |
|---|---|---|---|---|---|---|---|---|
| | FORMABILITY PARAMETERS | | | R Values | | | | |
| 2 | .59 | .65 | .62 | 0.62 | +.02 | 0.30 | 64. | OT |
| 3 | .58 | .77 | .73 | 0.70 | −.11 | 0.27 | 66. | OT |
| 4 | .76 | .64 | .67 | 0.69 | +.06 | 0.30 | 64. | OT |

*Sheet can be folded double without any crack.

The data in the above table shows that the lithium addition has not effected any significant alteration in the formability parameters of these readily formable alloy strips and sheets. Operations carried out with the alloys in sample preparation and testing provided corroboration of the excellent adaptability of such alloys to processing steps commonly used in converting sheets or plates to the desired configuration. In particular, the lithium-containing alloys displayed no increased tendency to acquire strain markings during fabricating steps.

It may further be noted that study of the foregoing data and observations has shown that the advantageous changes effected by the addition of lithium to aluminum-magnesium alloys in accordance with the invention are consistent with all, or substantially all, of the Li content being present in the alloy in solid solution.

It will be evident from the above-detailed description that this invention has embodied products, and procedures for producing them, which have successfully enabled the attainment of the specified objectives. It will further be understood that such attainment is not limited to the preferred embodiments of the invention, which are to be considered as illustrative of its best modes of operation, but that all modifications within the spirit thereof are to be considered within the scope specified by the appended claims.

What is claimed is:

1. An aluminum base alloy having improved resistance weldability plus excellent strength and formability, consisting essentially of 1.0 to 5.0% magnesium, 0.3–1.0% lithium, up to 1% manganese, up to 0.3% titanium, up to 0.20% vanadium, and balance aluminum, wherein said lithium is substantially retained in solid solution, said alloy being capable of withstanding elevated temperature without undue loss of strength and formability properties.

2. The alloy of claim 1 wherein up to 0.4% copper, up to 0.4% chromium, up to 0.3% zinc, up to 0.15% zirconium, and up to 0.3% nickel are present.

3. The alloy of claim 1 wherein said alloy consists essentially of 2.0 to 4.0% magnesium, 0.4 to 0.8% lithium, 0.1to 0.7% manganese, up to 0.2% titanium, up to 0.15% vanadium, and balance aluminum.

4. The alloy of claim 3 wherein 0.05 to 0.2% copper, up to 0.4% chromium, up to 0.3% nickel, up to 0.3% zinc, and up to 0.15% zirconium are present.

5. The alloy of claim 1 wherein up to about 0.45% of an element selected from the group consisting of iron, silicon, and mixtures thereof is present.

6. The alloy of claim 3 wherein as optional elements 0.05 to 0.15% vanadium, and 0.1 to 0.2% titanium are present.

7. The alloy of claim 1 consisting essentially of about 2.5% magnesium, 0.6% lithium, 0.5% manganese, 0.15% titanium, and balance aluminum.

8. The alloy of claim 1 wherein said alloy is in the annealed condition.

9. The alloy of claim 1 wherein said alloy is in the annealed and cold worked condition.

10. A wrought article having improved resistance weldability plus excellent strength and formability prepared from an aluminum base alloy consisting essentially of 1.0 to 5.0% magnesium, 0.3 to 1.0% lithium, up to 1% manganese, up to 0.3% titanium, and up to 0.20% vanadium, and balance aluminum, wherein said lithium is substantially retained in solid solution, said alloy being capable of withstanding elevated temperature without undue loss of strength and formability properties.

11. The article of claim 10, wherein up to 0.4% copper, up to 0.4% chromium, up to 0.3% zinc, up to 0.15% zirconium, and up to 0.3% nickel are present.

12. The article of claim 10 wherein said alloy consists essentially of from about 2.0 to 4.0% magnesium, 0.4 to 0.8% lithium, 0.1 to 0.7% manganese, up to 0.2% titanium, up to 0.15% vanadium, and balance aluminum.

13. The article of claim 12 wherein 0.05 to 0.2% copper, 0.1 to 0.4% chromium, up to 0.3% nickel, up to 0.3% zinc, and up to 0.15% zirconium are present.

14. The article of claim 12 wherein said alloy consists essentially of about 2.5% magnesium, 0.6% lithium, 0.5% manganese, 0.15% titanium, and balance aluminum.

15. The article of claim 10 wherein said article is in the annealed condition.

16. The article of claim 10 wherein said alloy is in the annealed and cold worked condition.

17. A method for the preparation of wrought products exhibiting improved resistance weldability plus excellent strength and formability, wherein said alloy is capable of withstanding elevated temperature without undue loss of strength and formability properties which comprises:

A. providing an aluminum base alloy consisting essentially of 1.0 to 5.0% magnesium, 0.3 to 1.0% lithium, up to 1% manganese, up to 0.3% titanium, up to 0.20% vanadium, and balance aluminum;

B. casting said alloy;

C. heating said alloy to a homogenizing temperature and thereafter homogenizing said alloy;

D. hot and cold working said alloy; and

E. annealing said alloy whereby said wrought products are capable of plastic deformation to form automotive body parts.

18. The method of claim 17 wherein said alloy consists essentially of 2.0 to 4.0% magnesium, 0.4 to 0.8% lithium, 0.1 to 0.7% manganese, up to 0.15% vanadium, up to 0.2% titanium, and balance aluminum.

19. The method of claim 17 where said alloy is cast by the DC casting method.

20. The method of claim 17 wherein said hot working is commenced at a temperature of about 850° F.

21. The method of claim 17 wherein said alloy is hot and cold worked by rolling.

22. The method of claim 17 wherein the heating of Step C is conducted at a rate of 50° F per hour to a homogenizing temperature of about 900° F, and said alloy is then held at said homogenizing temperature for about 4 hours.

23. The method of claim 17 wherein said alloy is annealed by heating at a rate of 50° F per hour from 300° to 650° F, and is then held at 650° F for about 3 hours.

* * * * *